US007815474B1

(12) United States Patent
Lin et al.

(10) Patent No.: US 7,815,474 B1
(45) Date of Patent: Oct. 19, 2010

(54) PROBE CONNECTOR HAVING A MOUNTING PLATFORM

(75) Inventors: Ming-Han Lin, Tu-Cheng (TW); Te-Hung Yin, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/550,256

(22) Filed: Aug. 28, 2009

(51) Int. Cl.
*H01R 13/24* (2006.01)

(52) U.S. Cl. ..... 439/700; 439/482; 439/824

(58) Field of Classification Search ..... 439/658, 439/700, 482, 824
See application file for complete search history.

(56) References Cited

U.S. PATENT DOCUMENTS 6,935,906 B2 * 8/2005 Orihara ..... 439/824
7,435,109 B1 * 10/2008 Sugiura ..... 439/83
7,662,000 B2 * 2/2010 Hou et al. ..... 439/824

* cited by examiner

*Primary Examiner*—Hae Moon Hyeon
(74) *Attorney, Agent, or Firm*—Cheng-Ju Chiang

(57) ABSTRACT

A probe connector includes an insulating housing and a probe pin assembly. The insulating housing has a base defining a front surface. The front surface has an inserting hole extending frontward and rearwards. A mounting platform is integrally surrounded a rear surface and two lateral surfaces of the base, with a top thereof lower than a top of the base. The mounting platform has a groove in alignment with and communicating with the corresponding inserting hole. The probe pin assembly mounted to the inserting hole comprises a cylindraceous barrel, an elastic element received in the barrel, and a plunger mounted to the barrel and exposing from an open end of the barrel. A closed end of the barrel is integrally formed with a soldering portion protruding opposite to the plunger and received in the groove for being soldered to a printed circuited board (PCB) when the PCB is mounted to the mounting platform.

7 Claims, 6 Drawing Sheets

PROBE CONNECTOR HAVING A MOUNTING PLATFORM

BACKGROUND OF THE INVENTION

1. Field of the Invention

The present invention relates to a probe connector, and particularly to a probe connector having a structure for connecting with a printed circuit board.

2. The Related Art

Probe connectors are mainly used in mobile phones for electrically connecting with contacts of cards or batteries mounted to the mobile phones. FIG. 10 is a cross-sectional view showing a probe connector 1' in prior art. The probe connector 1' generally includes an insulating housing 10' and a plurality of probe pin assemblies 20' mounted in the insulating housing 10'. The probe pin assembly 20' includes a cylindraceous barrel 21', with a closed end, an elastic element 23' received in the barrel 21', a plunger 22' mounted to the barrel 21' and having a free end extended outside from an open end of the barrel 21', for contacting an outer electrical device. However, the probe pin assembly 20' is mounted to the insulating housing 10' and requires a connection plate for connecting with a printed circuit board (PCB), which increases manufacturing cost and assembling time. Furthermore, such connection structure between the probe pin assembly 20' and the PCB is unsteady and may affect normal use of the mobile phone.

SUMMARY OF THE INVENTION

Accordingly, an object of the present invention is to provide a probe connector having a structure for connecting with a PCB. The probe connector includes an insulating housing and a probe pin assembly. The insulating housing has a base. The base defines a front surface, a rear surface opposite to the front surface, and two opposite lateral surfaces connecting with the front surface and the rear surface. The front surface of the base has an inserting hole extending frontward and rearwards. A mounting platform is integrally surrounded the rear surface and the two lateral surfaces of the base. A top of the mounting platform is lower than a top surface of the base and has a groove extending along a front and rear direction. The groove is in alignment with and communicates with the corresponding inserting hole. The probe pin assembly inserted into the inserting hole comprises a cylindraceous barrel, an elastic element received in the barrel, and a plunger mounted to the barrel and exposing from an open end of the barrel. A closed end of the barrel is integrally formed with a soldering portion protruding opposite to the plunger and received in the groove for being soldered to the PCB when the PCB is mounted on the top of the mounting platform.

As described above, the probe pin assembly is inserted into the inserting hole. The soldering portion integrated with the barrel is disposed in the groove. When the PCB is mounted on the top of the mounting platform, the soldering portion can be soldered to the PCB directly for achieving the electrical connection between the probe pin assembly and the PCB, without other component served as connecting element, which not only reduces manufacture cost and assembling time, but also guarantees the steady connection between the probe pin assembly and the PCB.

BRIEF DESCRIPTION OF THE DRAWINGS

The present invention will be apparent to those skilled in the art by reading the following description thereof, with reference to the attached drawings, in which.

DETAILED DESCRIPTION OF THE PREFERRED EMBODIMENT

Figure 8:
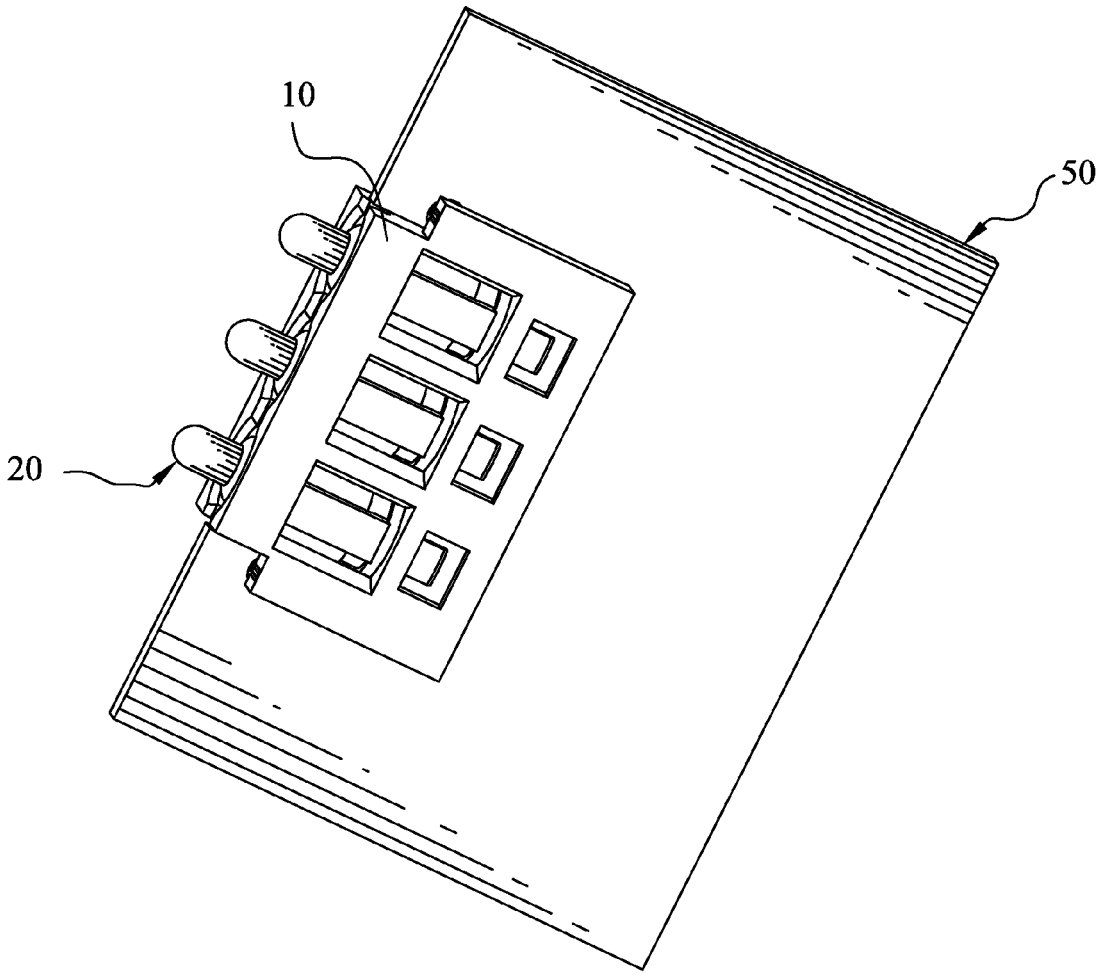
FIG. 8 is an assembled view illustrating the probe connector shown in FIG. 1 engaged with a PCB seen from a bottom angle.

Referring to the drawings in greater detail, and first to FIGS. 1-6, the embodiment of the invention is embodied in a probe connector 1. The probe connector 1 includes an insulating housing 10 and a plurality of probe pin assemblies 20 mounted to the insulating housing 10. The insulating housing 10 has a substantially rectangular base 11. The base 11 defines a front surface 111, a rear surface 112, a bottom surface 113 and two opposite lateral surfaces 114. The front surface 111 has a plurality of columned inserting holes 115, arranged side by side, for receiving the probe pin assemblies 20. A mounting platform 12 is integrated with the base 11 and encloses the rear surface 112 and the lateral surfaces 114, with a bottom thereof flush with the bottom surface 113. The mounting platform 12 for holding a printed circuit board (PCB) 50 (shown in FIGS. 8-9) defines a top 125 and a rear face 121. The top 125 of the mounting platform 12 is lower than a top surface of the base 11. A plurality of grooves 122 are formed on the top 125 of the mounting platform 12, and spaced away from one another, passing through the rear face 121. The grooves 122 are in alignment with and communicate with the corresponding inserting holes 115. A portion between the adjacent grooves 122 is formed an open slot 123. Two corners of the top 125 of the mounting platform 12 are protruded upwards to form fixing pegs 124, adjacent to the outermost grooves 122. The fixing pegs 124 are arranged in parallel with fixing elements 40 described hereinafter, when the fixing elements 40 are mounted into the slots 123. The two portions of the mounting platform 12 attached to the respective lateral surfaces 114 have front ends thereof rearward of the front surface 111 and formed with open slots 123 for receiving installing elements 30, respectively.

Figure 1:
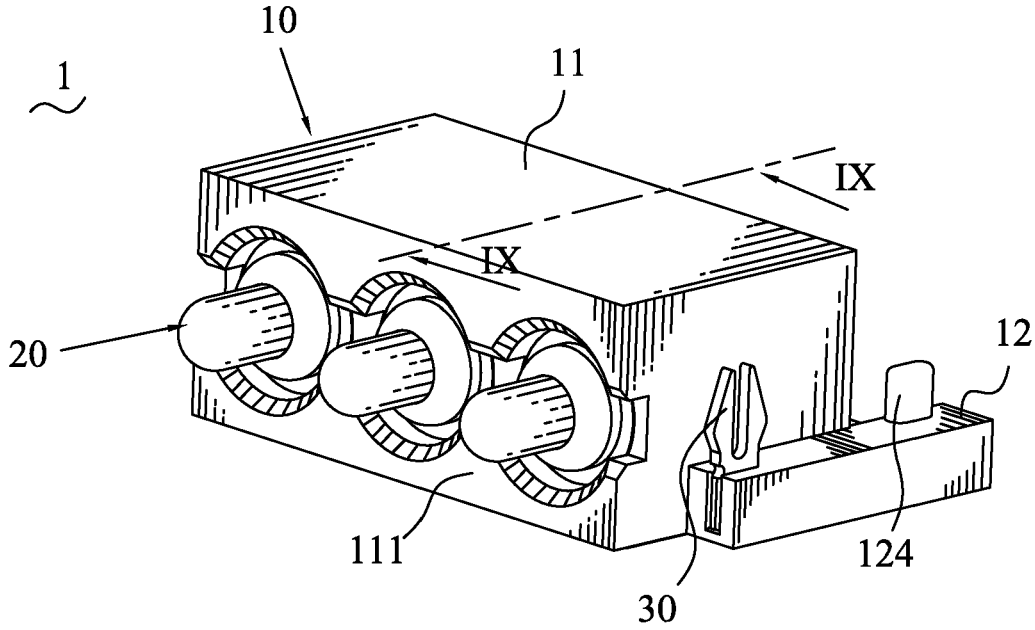
FIG. 1 is an assembled, perspective view of a probe connector of an embodiment in accordance with the present invention.
Figure 2:
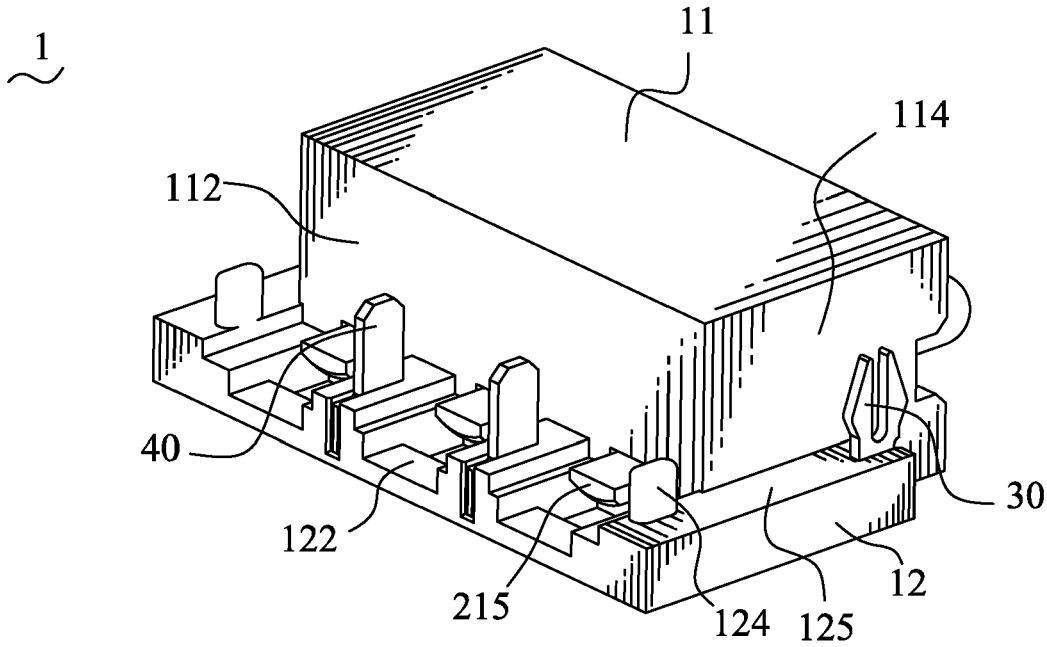
FIG. 2 is an assembled, perspective view of the probe connector shown in FIG. 1 seen from another view.
Figure 3:
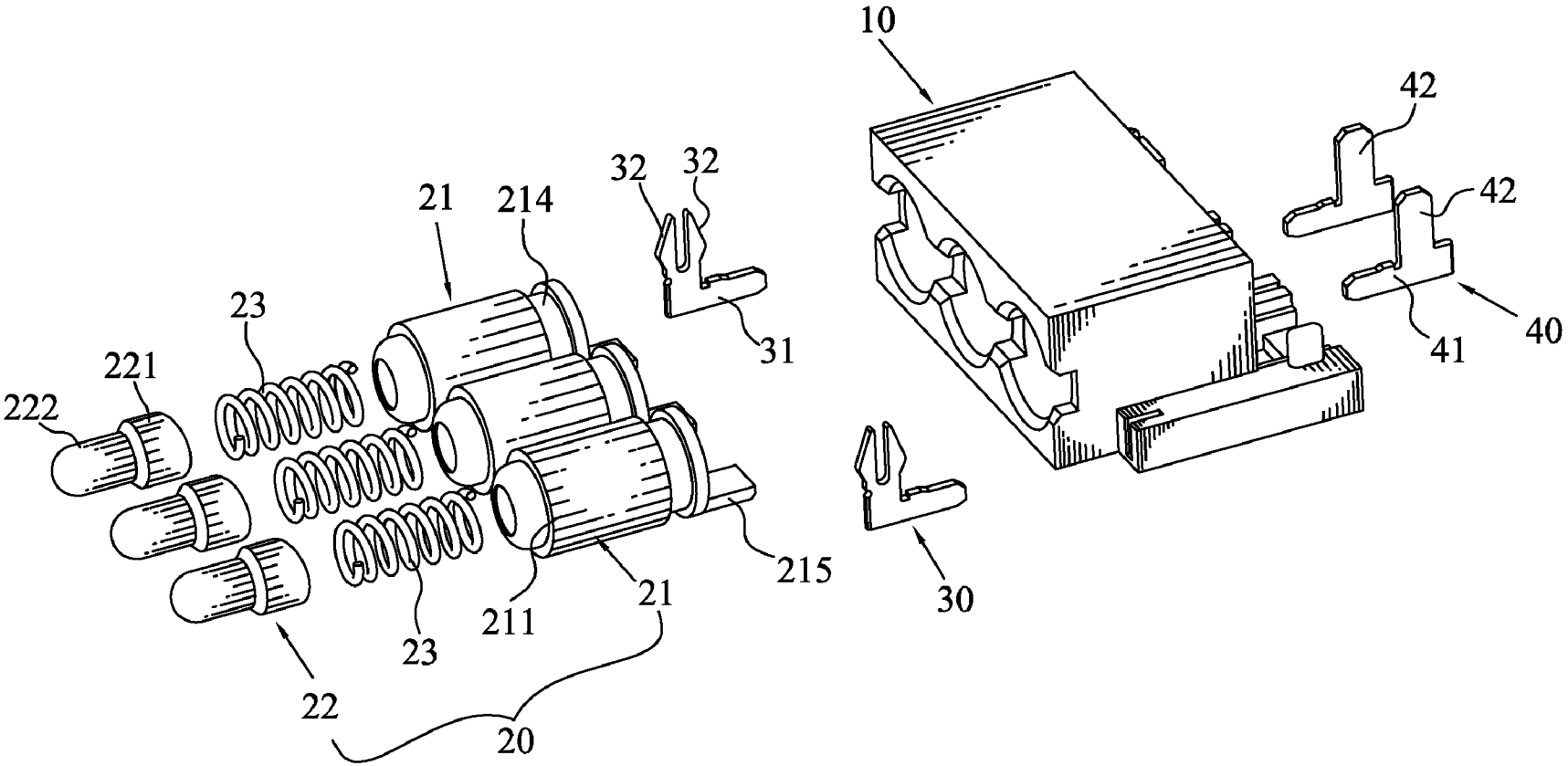
FIG. 3 is an exploded perspective view of the probe connector shown in FIG. 1.
Figure 4:
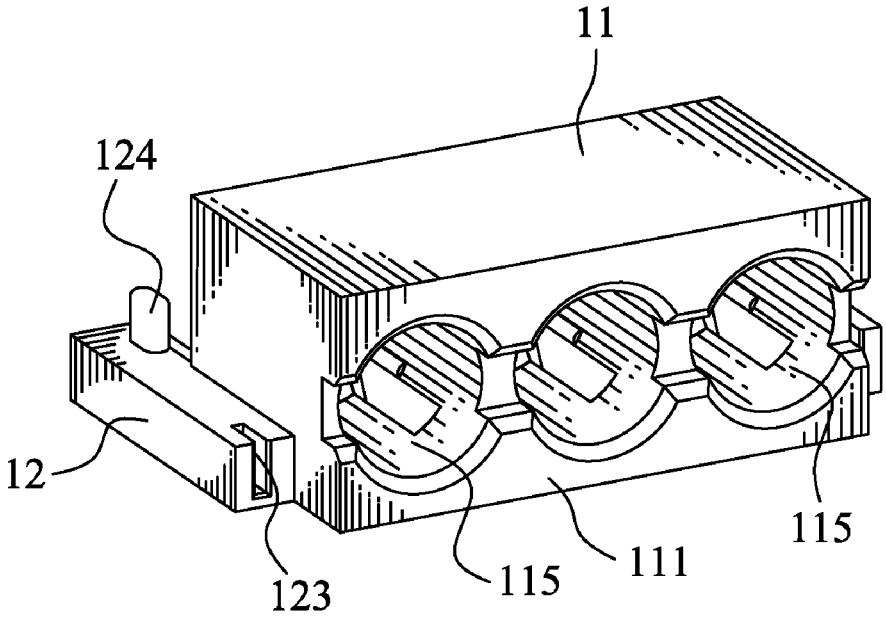
FIG. 4 is a perspective view of an insulating housing of the probe connector shown in FIG. 3 seen from a front angle.
Figure 5:
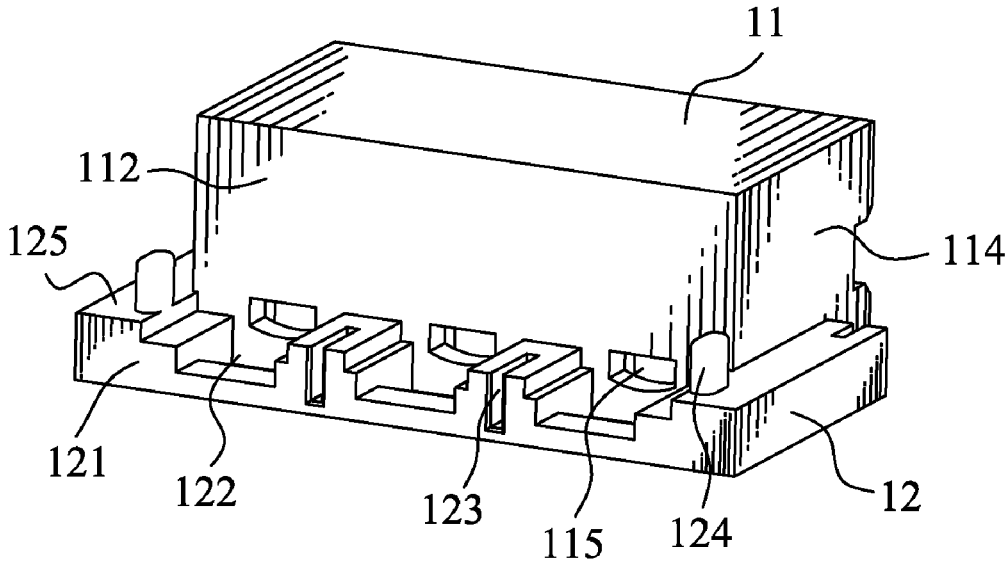
FIG. 5 is a perspective view of the insulating housing of the probe connector shown in FIG. 3 seen from a rear angle.
Figure 6:
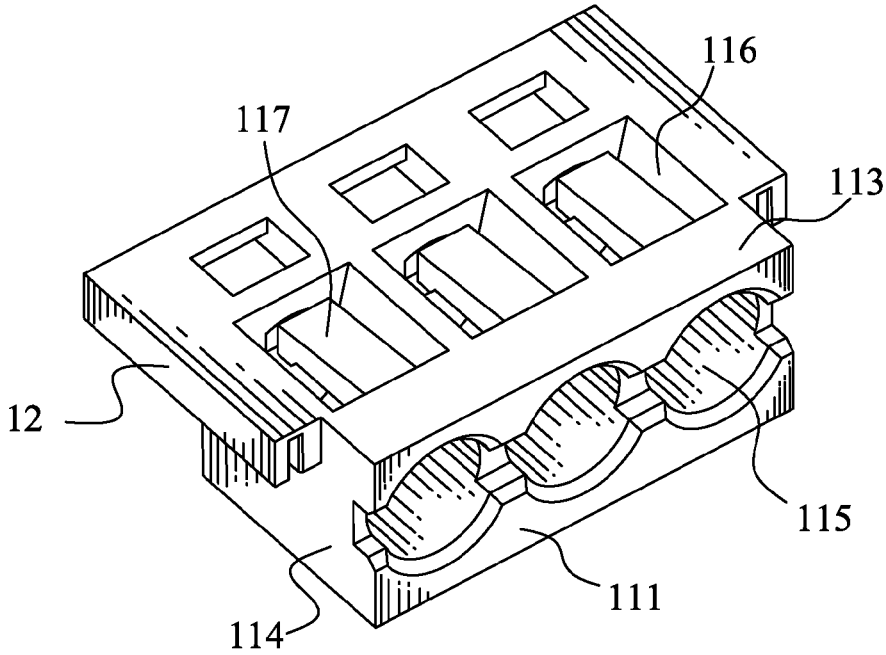
FIG. 6 is a perspective view of the insulating housing of the probe connector shown in FIG. 3 seen from a bottom angle.
Figure 7:
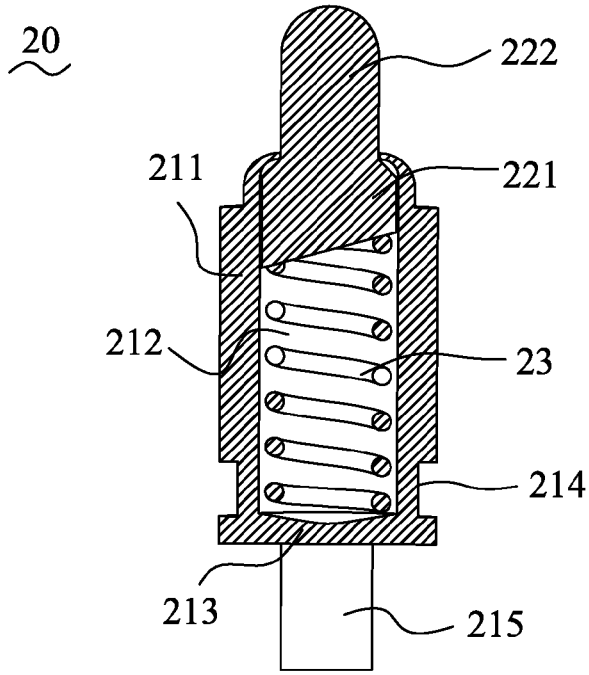
FIG. 7 is a cross-sectional view of a probe pin assembly of the probe connector shown in FIG. 1.
Figure 9:
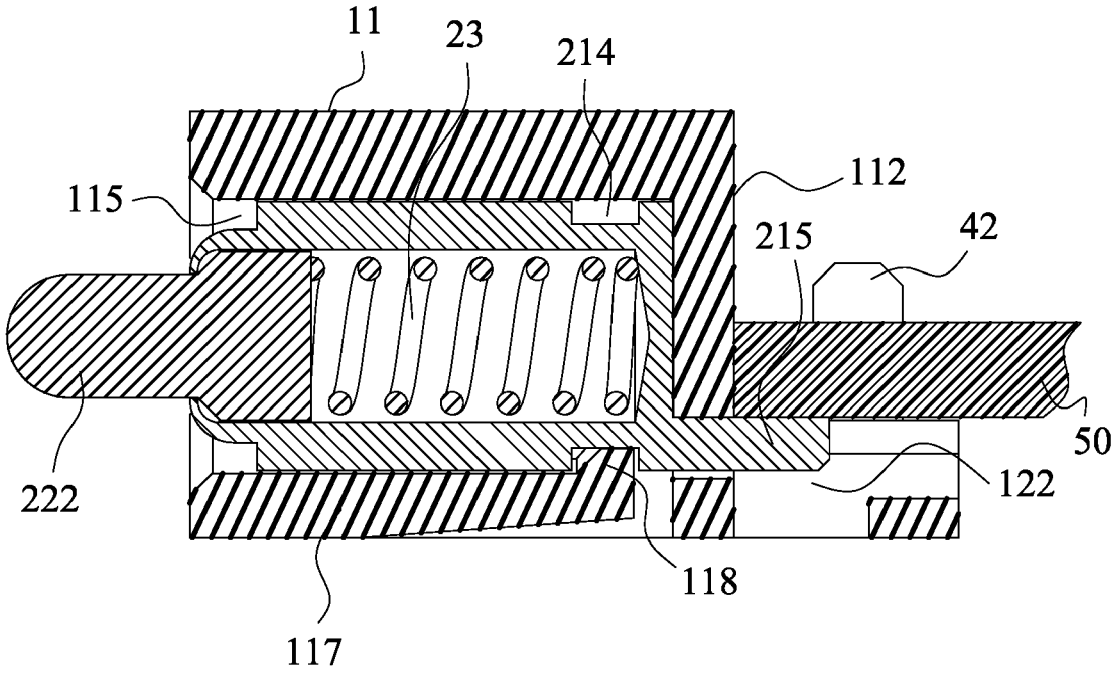
FIG. 9 is a cross-sectional view taken on IX-IX of FIG. 1.
Figure 10:
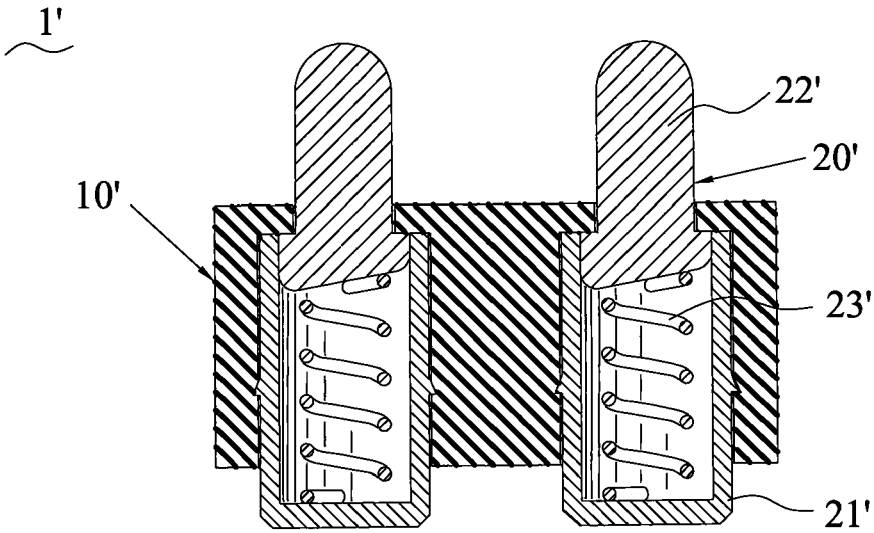
FIG. 10 (Prior Art)
FIG. 10 is a cross-sectional view of a probe connector in prior art.

Referring to FIG. 4, FIG. 6 and FIG. 9, the bottom surface 113 has a plurality of windows 116, communicating with the corresponding inserting holes 115. A front side of each of the windows 116 has a portion extended rearwards to form a locking arm 117. The locking arm 117 has a locking hook 118 at a free end thereof, projecting into the inserting hole 115 for securing the inserted probe pin assembly 20.

Referring to FIG. 3 and FIGS. 7-9, the probe pin assembly 20 includes a hollow barrel 21, a plunger 22 and an elastic element 23 received in the barrel 21. The barrel 21 and the plunger 22 are made of metallic material. The barrel 21 has a cylindraceous main body 211, surrounding a chamber 212, and defines a bottom plate 213 integrally sealed an end thereof for being against one end of the elastic element 23. An outer surface of the main body 211 has a portion depressed inwards to form a buckling recess 214 around the main body 211 and adjacent to the bottom plate 213, corresponding to the locking hook 118. An outer surface of the bottom plate 213 has a portion adjacent to a side thereof extending opposite to the main body 211 to form a soldering portion 215 of strip shape. In assembly, the PCB 50 is fixed on the top 125 of the mounting platform 12, enclosing the rear surface 112 and the two lateral surfaces 114 of the base 11. The soldering portion 215 projects out of the base 11 and is placed in the groove 122, for being soldered to a bottom of the PCB 50. In this embodiment, a surface of the soldering portion 215 facing upwards is substantially flush with the top 125 of the mounting platform 12. The plunger 22 of cylindrical shape includes a basic portion 221 and a contact portion 222 extending outwards from one end of the basic portion 221. The basic portion 221 is restrained in the chamber 212 of the barrel 21, where a bottom of the basic portion 221 is against the other end of the elastic element 23. The contact portion 222 extends out of the barrel 21 through an end of the main body 211 opposite to the bottom plate 213. The probe pin assembly 20 is inserted into the inserting hole 115 from a front direction. The locking arm 117 is extruded by the barrel 21 and deflects outwards resiliently. The locking hook 118 slides along the outer surface of the barrel 21 and buckles into the buckling recess 214 for fixing the probe pin assembly 20 to the insulating housing 10 firmly, thereby preventing the probe pin assembly 20 from moving along with the insulating housing 10.

Referring to FIGS. 1-3 and FIG. 8, the installing element 30 has an installing piece 31 of strip shape and a pair of wedge-shaped pieces 32 extending upwards from an end of a side of the installing piece 31 side by side. The installing piece 31 is inserted into the slot 123 adjacent to the lateral surface 114. The wedge-shaped piece 32 is used to snap into a notch of PCB 50 for fixing the PCB 50 and the probe connector 1 together, when the PCB 50 is laid on the top 125 of the mounting platform 12. The fixing element 40 has a fixing piece 41 of strip shape and a rectangular piece 42 extending upwards from an end of a side of the fixing piece 41. The fixing piece 41 is received in the slot 123 adjacent to the rear surface 112. The rectangular piece 42 is in alignment with the fixing pegs 124 for being inserted into a corresponding notch of the PCB 50.

As described above, the probe pin assembly 20 is inserted into the inserting hole 115. The soldering portion 215 integrated with the main body 211 is disposed in the groove 122, contacting the PCB 50 when the PCB 50 is mounted to the mounting platform 12. Thus the soldering portion 215 can be soldered to the PCB 50 directly for achieving the electrical connection between the probe pin assembly 20 and the PCB 50, without other component served as connecting element, which not only reduces manufacture cost and assembling time, but also guarantees steady connection between the probe pin assembly 20 and the PCB 50.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A probe connector connected with a printed circuit board (PCB), comprising:

an insulating housing having a base, the base defining a front surface, a rear surface opposite to the front surface, and two opposite lateral surfaces connecting with the front surface and the rear surface, the front surface of the base having an inserting hole extending frontward and rearwards, a mounting platform integrally surrounded the rear surface and the two lateral surfaces of the base, a top of the mounting platform being lower than a top surface of the base and having a groove extending along a front and rear direction, the groove in alignment with and communicating with the corresponding inserting hole; and a probe pin assembly mounted into the inserting hole, the probe pin assembly comprising a cylindraceous barrel, an elastic element received in the barrel, and a plunger mounted to the barrel and exposing from an open end of the barrel, an closed end of the barrel integrally formed with a soldering portion protruding opposite to the plunger and received in the groove for being soldered to the PCB when the PCB is mounted on the top of the mounting platform.

2. The probe connector as claimed in claim 1, further comprising a plurality of fixing elements mounted to the mounting platform adjacent to the rear surface of the base, two corners of the mounting platform extended upwards to form fixing pegs which are arranged in parallel with the fixing elements.

3. The probe connector as claimed in claim 2, wherein the fixing element has a fixing piece of strip shape received in an open slot formed on the top of the mounting platform, and an rectangular piece extending upwards from an end of a side of the fixing piece and juxtaposed with the fixing pegs, for fixing the PCB.

4. The probe connector as claimed in claim 1, further comprising a plurality of installing elements mounted to the mounting platform adjacent to the lateral surfaces of the base, the installing element having an installing piece of strip shape for mounting into an open slot formed the mounting platform, and a pair of opposite wedge-shaped pieces extending upwards from an end of a side of the installing piece for fixing with the PCB by a snap fit.

5. The probe connector as claimed in claim 1, wherein the insulating housing having a window at a bottom surface thereof, the window communicates with the inserting hole and extending rearwards from a front side thereof to form a resilient locking arm projecting into the inserting hole, the locking arm is buckled into a buckling recess formed at a periphery of the barrel for fixing the probe pin assembly and the insulating housing together.

6. The probe connector as claimed in claim 5, wherein the locking arm has a hooked distal end protruding into the inserting hole for engaging with the buckling recess of the inserted probe pin assembly.

7. The probe connector as claimed in claim 5, wherein the buckling recess is extended along the circumference of the barrel.

* * * * *